United States Patent [19]

Carroll

[11] Patent Number: 4,890,402

[45] Date of Patent: Jan. 2, 1990

[54] PHOTOGRAPH HOLDING GREETING CARD

[76] Inventor: Philip C. Carroll, 5300 Hayes, NW., Albuquerque, N. Mex. 87120

[21] Appl. No.: 265,048

[22] Filed: Oct. 31, 1988

[51] Int. Cl.[4] ..... A47G 1/06; G09F 1/10

[52] U.S. Cl. ..... 40/159; 40/124.1

[58] Field of Search ..... 40/158.1, 159, 124.1; 229/92.8; 434/99; 446/147; 283/77, 117

[56] References Cited

U.S. PATENT DOCUMENTS

| | | | |
|---|---|---|---|
| 279,490 | 6/1883 | Lane | 40/152 |
| 816,870 | 4/1906 | Markoff | 229/92.8 |
| 1,031,521 | 7/1912 | Carmeron | 446/147 |
| 2,176,535 | 10/1939 | Markoff | 40/159 |
| 2,256,399 | 9/1941 | MacHarg | 40/152 |
| 2,360,916 | 10/1944 | Von Trott | 446/147 |
| 2,547,359 | 4/1951 | Bacharach | 446/147 |
| 2,878,607 | 3/1959 | Alves | 40/158.1 |
| 3,174,244 | 3/1965 | Walton | 40/158.1 |
| 3,304,641 | 2/1967 | Gonczy | 40/158.1 |
| 3,638,343 | 2/1972 | West | 40/124.1 |
| 3,713,238 | 1/1973 | Hyman | 40/158.1 |
| 3,847,325 | 11/1974 | Nasalski et al. | 229/92.8 |
| 3,875,693 | 4/1975 | Pelkey | 40/124.1 |
| 4,008,852 | 2/1977 | Davis | 229/92.3 |
| 4,079,881 | 3/1978 | Sabb | 229/92.8 |
| 4,237,633 | 12/1980 | Murrell | 40/158.1 |
| 4,662,093 | 5/1987 | Suttles et al. | 40/158.1 |
| 4,681,253 | 7/1987 | Engelhardt | 229/92.8 |

*Primary Examiner*—Cary E. Stone

*Attorney, Agent, or Firm*—Deborah A. Peacock; Robert W. Weig

[57] ABSTRACT

A photograph holding greeting card and kit comprising a jacket, an insert, and a transparent pocket for holding a photograph on the front face of the jacket. The insert includes a preprinted message. A selection of a plurality of inserts are provided for the user to place a message or greeting within the jacket.

20 Claims, 4 Drawing Sheets

PHOTOGRAPH HOLDING GREETING CARD

FIELD OF THE INVENTION

The invention relates to photograph holding greeting cards and more particularly to photograph holding greeting card kits which provide a selection of a plurality of inserts, each of which contains a different distinctive message preprinted thereon.

BACKGROUND OF THE INVENTION

Although the greeting card art is of long standing, there have been relatively few attempts to provide a card or card kit capable of providing truly personalized messages, particularly in combination with a photograph to be provided by a sender.

There are numerous prior art patents which disclose greeting cards or postcard variations incorporating photographs. However, there are no cards in the prior art which disclose a combination of a photograph on the face of the greeting card with a selection of message inserts. Some of the prior art cards are discussed below.

U.S. Pat. Nos. 279,490 to Lane, entitled ORNAMENTAL CARD, and 2,878,607 to Alves, entitled PHOTO-MOUNT GREETING CARD, disclose greeting cards with a preprinted message and an aperture for display of a photograph or memento.

U.S. Pat. Nos. 816,870 to S. A. Markoff, entitled PHOTOGRAPHIC MAILING CARD; 2,256,399 to MacHarg, entitled MAILING CARD; 3,174,244 to Walton, entitled COMBINATION PHOTOGRAPH EASEL AND MAILING ENVELOPE UNIT; 3,713,238 to Hyman, et al., entitled POSTCARD INCLUDING PHOTOGRAPH MOUNTING MEANS; 3,875,693 to Pelkey, entitled MESSAGE BEARING PHOTO EASEL; 4,008,852 to Davis, entitled APERTURED MAILING CARD AND METHOD OF USING; and 4,681,253 to Englehardt, entitled EFFICIENCY PHOTO-GRAM WITH STAND-UP DISPLAY, all disclose a card with a photo display opening, leaving a blank space for writing or omitting a message.

U.S. Pat. Nos. 2,176,535 to T. Markoff, entitled GREETING CARD, and 2,547,359 to Backarach, entitled COMBINATION GREETING CARD AND FRAMED PICTURE, disclose a greeting card with a removable image holder for independent display.

U.S. Pat. No. 3,638,343 to West, entitled OCCASIONAL CARD, discloses a collapsible box with an insert holder.

U.S. Pat. No. 2,360,916 to Von Trott, entitled FOLDED GREETING CARD CONSTRUCTION, discloses an aperture in combination with selected messages; however, it does not contemplate insertion of a photograph or independent design for viewing through the aperture.

As stated previously, none of these patents disclose or suggest attaching a photograph on the face of a greeting card in the manner of the instant invention, in combination with selected inserts having preprinted messages.

SUMMARY OF THE INVENTION

In accordance with the present invention, there is provided a photograph holding greeting card kit comprising a jacket made of cardstock comprising an exterior surface, an interior surface, at least one fold in the cardstock, and a front face on the exterior surface, and a transparent pocket disposed on the front face of the exterior surface of the jacket for receiving and holding a photograph of a predetermined size, provided by a user. There is also provided a selection of a plurality of inserts, each insert comprising an exterior surface and an interior surface, the interior surface of the insert further comprising distinctive message indicia preprinted thereon; and a means for adhering the exterior surface of a selected one of the selection of a plurality of inserts to the interior surface of the jacket to provide a greeting card with a message appropriate to the photograph selected to be positioned and held within the transparent pocket on the front face of the exterior surface of the jacket.

The selected insert may be adhesively attached on its exterior surface to the interior surface of the jacket. An adhesive may be removably attached to the exterior surface of the selected insert or to the interior surface of the jacket. The adhesive is preferably disposed on the exterior surface of the selected insert.

The adhesive may appear in any convenient size or shape, such as circular spots, strips, rectangular patches, or the like, and in any convenient place or places. The adhesive may further comprise areas of adhesive on the interior surface of the jacket, or be disposed on the transparent pocket for affixing the insert to the jacket, or may further serve to affix the transparent pocket to the jacket. An adhesive for affixing the transparent pocket may be disposed on the pocket or jacket to affix the pocket to the jacket.

The adhesives preferably comprise peel off covers disposed over the areas of adhesive whereby the user peels the covers from the areas of adhesive to expose the areas of adhesive and then positions and attaches the exterior surface of the selected insert to the interior surface of the jacket by adhering the areas of adhesive on the exterior surface of the insert to the interior surface of the jacket.

At least one of the selection of a plurality of inserts comprises one or more folds. The insert and the jacket may comprise adjacent sections divided by a fold with each section of the insert preferably comprising an adhesive on the exterior surface of the insert. In the preferred embodiment, the insert is generally rectangular in shape and approximately the same size and shape of the jacket and each of the adjacent sections divided by the fold comprises an upper edge, a lower edge, a side edge, and a fold edge.

The jacket and transparent pocket preferably comprise generally rectangular sheets, the sheet of the transparent pocket being slightly longer than the front face of the exterior surface of the jacket, and the upper and lower edges of the sheet of the transparent pocket being foldable over the upper and lower edges of the jacket. The upper and lower edges of the transparent pocket are preferably folded over the upper and lower edges of the jacket and disposed between the jacket and the insert when the insert is adhered to the jacket.

The adhering areas may comprise at least two strips of adhesive on the exterior surface of each insert or jacket section, but may comprise a plurality of adhering areas. The adhesive strips are preferably disposed adjacent and essentially parallel to two or more edges of the insert. As may be seen, the adhesive strips, spots, or patches may be disposed on edges adjacent to the upper and lower edges of the insert; or the adhesive strips may be disposed on the side and fold edges of the insert; or may comprise three adhesive strips disposed adjacent and essentially parallel to the upper edge, the lower edge, and the side edge of the insert. In another embodiment, four adhesive strips may be disposed on the exterior surface of each section of the insert, one strip disposed adjacent and essentially parallel to the upper edge, the lower edge, the side edge, and the fold edge.

One object of the present invention is to provide a greeting card with a choice of messages to go with a chosen photograph in the greeting card.

Another object of the invention is to lower the cost of inventorying photograph holding greetig cards.

One advantage of the instant invention is that a wide choice of photograph holding greeting card covers and message containing inserts can be offered to users with relatively few jackets and inserts.

Another advantage of the invention is that appropriate messages can be provided with chosen photographs in a photograph holding greeting card.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention.

DETAILED DESCRIPTION OF A PREFERRED EMBODIMENT

OF THE INVENTION

Figure 1:
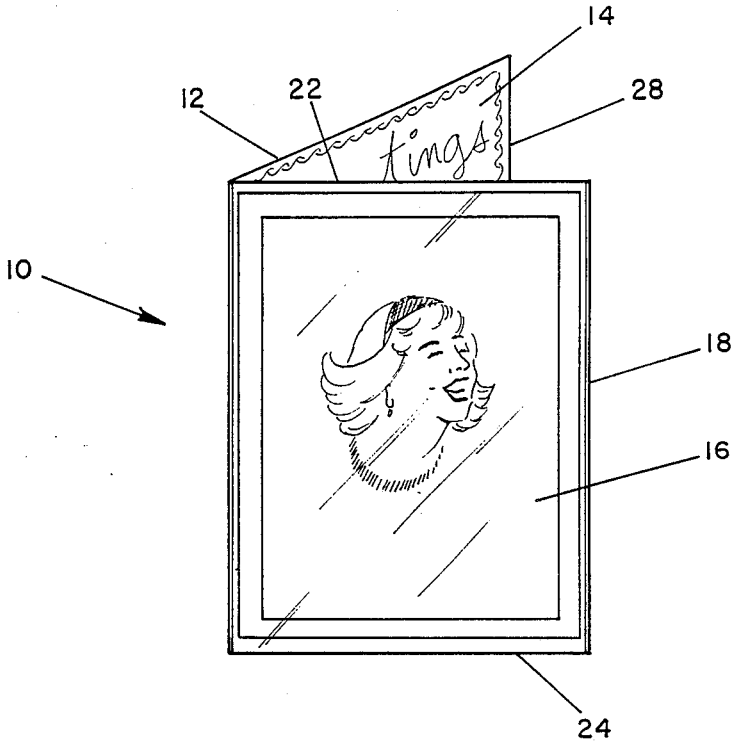
FIG. 1 illustrates a preferred embodiment of the invention assembled into a greeting card.
Figure 2:
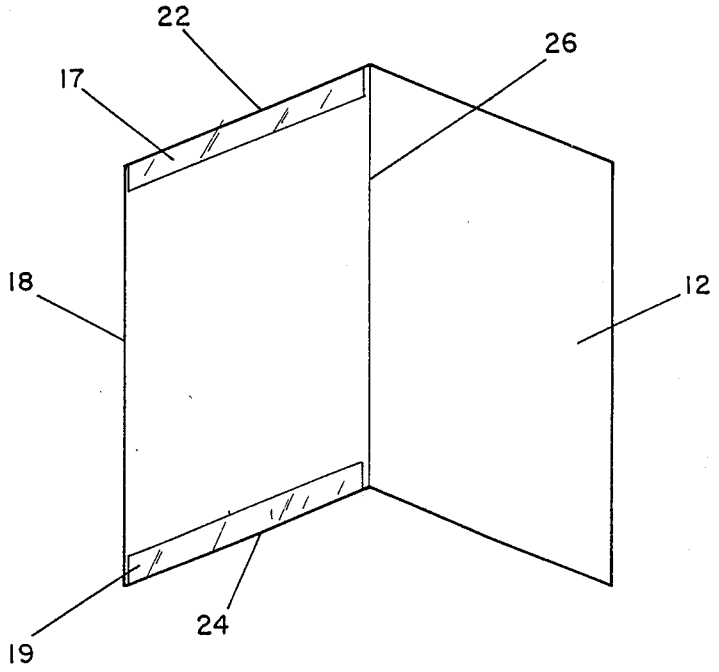
FIG. 2 shows the inside of the jacket and photograph holding pocket of the FIG. 1 embodiment.
Figure 3:
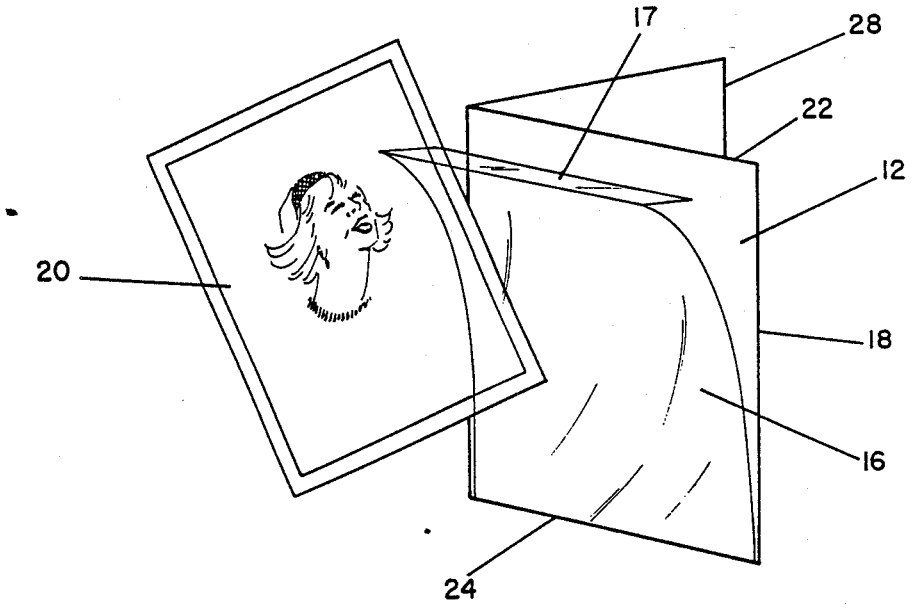
FIG. 3 shows a photograph being inserted into the photograph holding pocket of the jacket of the FIG. 1 embodiment.

The present invention comprises a card jacket, a transparent photograph holding pocket on the jacket sized to fit a photograph of a predetermined size, such as a 5" by 7" size, and a selection of a plurality of message containing inserts. A user selects an insert from the plurality of messages to go with his or her chosen photograph. Inserts of various colors or tints can be provided within the selection of inserts. The chosen photograph is inserted into the photograph holding pocket and the insert selected is adhered within the jacket.

Reference is now made to the drawings which illustrate a preferred kit embodiment of the invention 10 comprising a jacket 12, an insert 14, and a transparent pocket 16 for holding a photograph 20, provided by the user, on the front face of the jacket 12. A user provides the photograph 20, places the photograph 20 in the transparent pocket 16, selects an insert 14, and affixes the insert 14 to the jacket 12, thereby assembling the card 10 of the invention.

The jacket 12 is preferably constructed of one piece of cardstock with a central fold 26, although several sheets of cardstock may be fused together at the fold 26. The jacket 12 has interior and exterior surfaces. The front face is disposed on the exterior surface of the jacket 12.

In the preferred embodiment, the face or front cover of the jacket 12 is sized to fit a conventional size photograph 20, such as a 5" by 7" photograph, and the like. The jacket can alternatively be larger than the photograph to be used. The transparent pocket may be sized to fit the photograph or it may be larger than the size of the photograph. The jacket 12 is preferably symmetric about its fold 26, although it need not be. The drawings illustrate a single fold, rectangular-shaped greeting card, although any number of folds and shapes of cards may be utilized in accordance with the invention.

In the preferred embodiment, the transparent pocket 16, which preferably comprises a sheet of clear acetate, is neatly folded over the top and bottom edges 22 and 24 of the front face of the jacket 12 to form an upper flap 17 and lower flap 19 for holding the photograph 20 therein (see FIGS. 2, 3, 7, and 8). Although in the preferred embodiment of the invention, the transparent pocket 16 opens along the side edge 18 and fold 26 of the jacket 12 (see FIGS. 2, 3, 7, and 8) those skilled in the art will appreciate that the transparent pocket sheet 16 may fold over the side edges 18 and 28 of the jacket 12 so that the pocket opening can be at the top and bottom edges 22 and 24 of the jacket 12 (this embodiment is not shown). The transparent pocket 16 can be positioned on the face of the jacket 12 in any desired position, such as centered, or otherwise, and need not fold over the edges as shown in the drawings. The transparent pocket 16 is preferably made of a relatively stiff material so that a neat and workmanlike product results. Nevertheless, rather flexible transparent material can be used to form the pocket 16 in accordance with the invention.

As used throughout the specification and claims, the term "photograph" is intended to include an image provided by the user. This photograph is not part of the kit or card of the invention and is thus not provided by a manufacturer.

Figure 4:
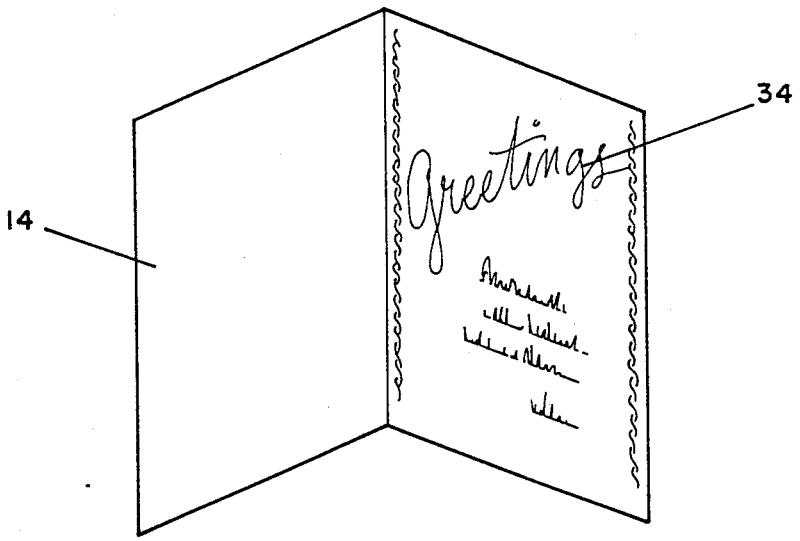
FIG. 4 shows one selected insert of the FIG. 1 embodiment.
Figure 5:
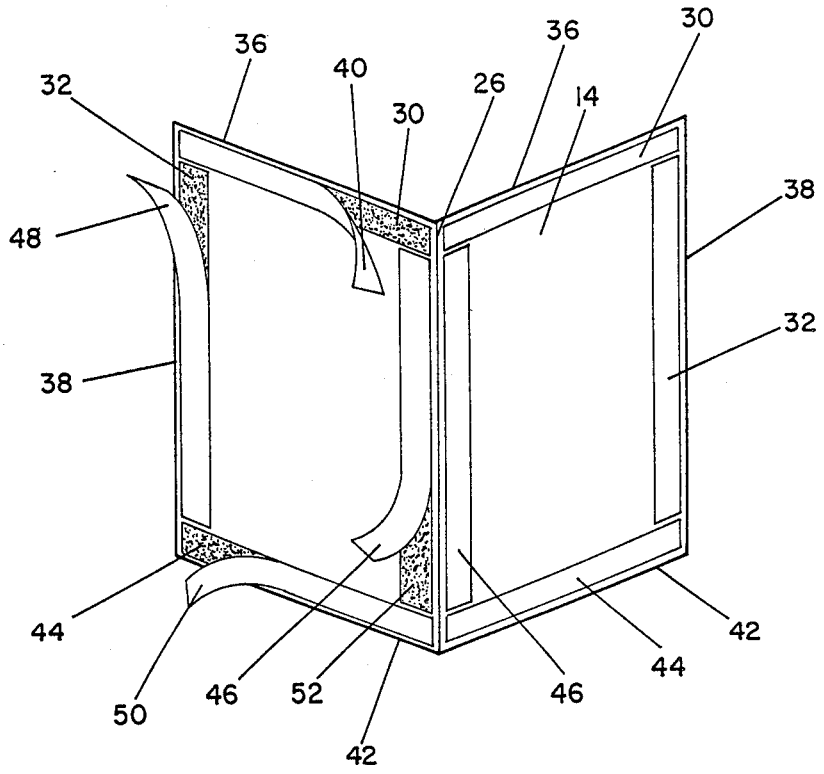
FIG. 5 shows the back of the insert of FIG. 4, having adhesive strips for attachment to the jacket.

The insert 14 is shown in FIGS. 4 and 5 and preferably contains distinctive preprinted message indicia 34, such as "Greetings," "Merry Christmas," "Happy Hanukkah," "Happy Birthday," and the like. As used throughout the specification and claims, the term "preprinted" means indicia provided by a manufacturer, and is not limited to any particular printing technology. For instance, embossed messages would be included in this term. The insert 14 shown in the drawing has one fold. However, the insert may comprise more than one fold or have no folds in accordance with the invention. Inserts 14 and jackets 12 can be provided in several like or contrasting colors to provide a wide selection of possible combinations to go with photographs of various types and having sundry colors and themes. For example, springtime colors usually differ from fall colors. Too, colors such as red are frequently used in Valentine's Day and Christmas greeting cards. The user selects an insert 14 for placement in the card 10 of the invention.

Figure 6:
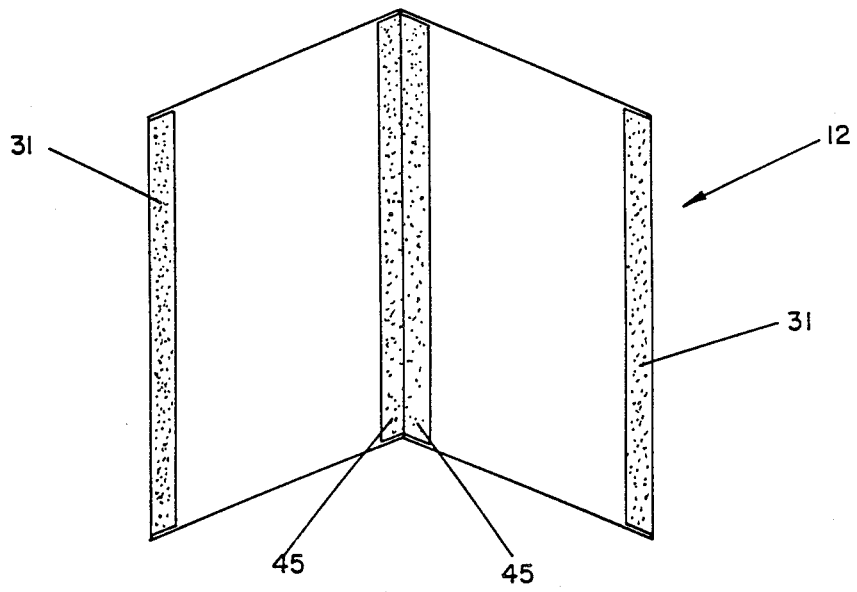
FIG. 6 shows an alternative embodiment of FIG. 1 wherein the inside of the jacket has adhesive strips for attaching the insert to the inside face of the jacket.
Figure 7:
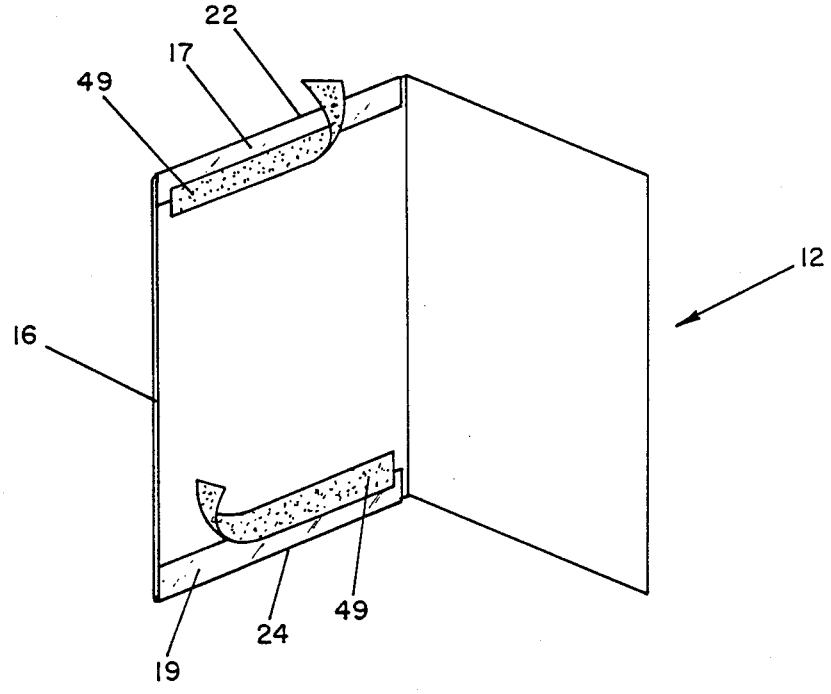
FIG. 7 shows another alternative embodiment of FIG. 1 wherein the transparent holding pocket has adhesive strips to hold the jacket, pocket and insert together.
Figure 8:
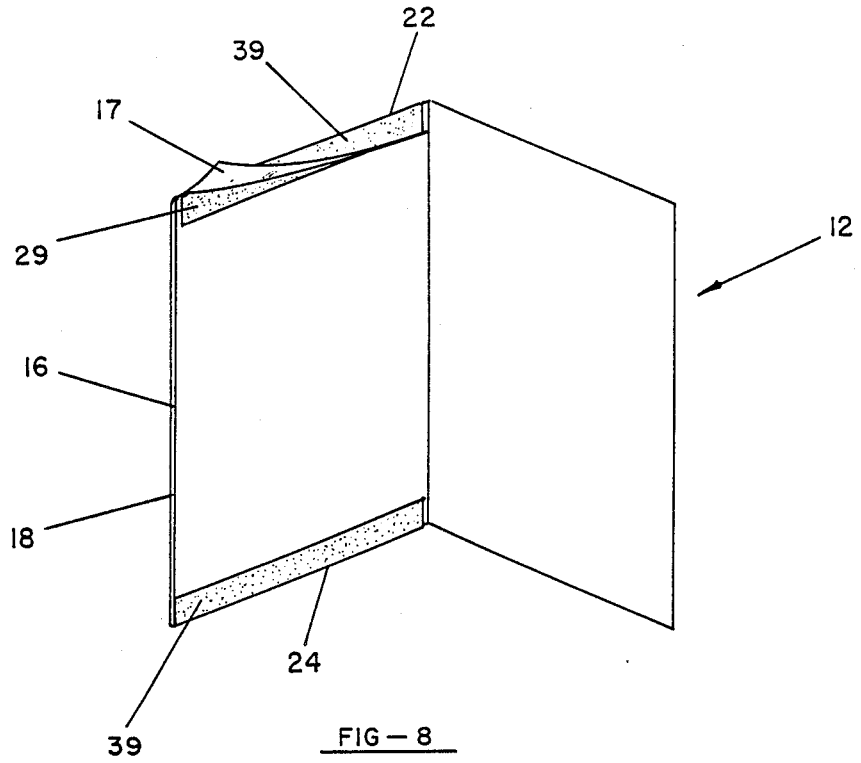
FIG. 8 shows still another embodiment of FIG. 1 wherein the transparent holding pocket has adhesive strips to hold the jacket and pocket together.

Either the jacket 12 (see FIG. 6), the insert 14 (see FIG. 5), or the transparent pocket sheet 16 (see FIGS. 7 and 8) is provided with adhesive areas for attaching one to the other. In the preferred embodiment (see FIG. 5), insert 14 comprises adhesive strips 30, 32, 44, and 46 adjacent and parallel to its edges 36, 38, and 42, and to the fold 26. Although in the preferred embodiment the adhesive areas comprise strips 30, 32, 44, and 46, adhesive means can be disposed on the jacket 12, insert 14, or transparent pocket 16, in any convenient size, shape, place, or places, such as circular spots, rectangular patches, or the like. The adhesive areas should be of a sufficient size and shape and positioned so that the insert 14 is adequately affixed to the interior surface of the jacket 12 and the transparent pocket 16 is held in place. Adhesive strips are preferably placed on two, three, or four edges of the insert when the insert is rectangular in shape. In an alternative embodiment in which the adhering or adhesive means 31 and 45 are disposed on the jacket 12 (as shown in FIG. 6) these adhesive means should be positioned so as not to interfere with the transparent pocket for example, positioning on the side edge and the fold edge of the jacket 12 when the transparent pocket 16 folds over on the upper and lower edges. Likewise, in another alternative embodiment wherein the adhesive means are disposed on the transparent pocket as shown in FIGS. 7 and 8 the adhesive means would need to be positioned to enable the insert to be affixed to the jacket 12. For example, the upper and lower flaps 17 and 19 could be provided with double-sided adhesives 49 as shown in FIG. 7. Adhesives 29 as shown in FIG. 8 can also be provided to affix the transparent pocket 16 to the jacket 12, without necessarily affixing the insert to the jacket, which could require separate adhesives 39. As can be appreciated by those skilled in the art, many types and positioning of adhesive means are possible with the present invention and the invention is not limited to the embodiment illustrated in the drawings or the means discussed above.

As seen in FIG. 5, adhesive strips 30, 32, 44, and 46 can be provided with covers 40, 48, 50, and 52 which are peeled off by a user prior to assembly of the jacket 12 and insert 14. The covers 40, 48, 50, and 52 are shown in FIG. 5 only on one face of the insert 14. As can be appreciated by one skilled in the art, covers could be provided on all adhesive strips. After the covers are peeled off, the selected insert 14 is placed within the jacket 12 and pressure is applied by the user to secure the insert 14 to the jacket 12, thereby sealing the edges of the transparent pocket 16 so that the photograph 20 is held securely in place therein.

The invention is best carried out by providing a selection of jackets of varying colors and designs, and the like, for photographs of predetermined sizes. A user selects a particular jacket of an appropriate size, color and design to attractively display his or her selected photograph. He or she then selects an insert from a selection comprising a plurality thereof for use with the selected jacket. In the preferred embodiment, the user peels the covers from the adhesive strips, positions the insert appropriately inside the jacket cover, and applies pressure over the adhesive areas to secure the insert into the jacket. The user, either before or after attaching the insert, inserts the photograph into the transparent pocket.

The invention has been described in detail with particular reference to a preferred embodiment thereof, but it will be understood that variations and modifications can be effected within the scope of the invention.

What is claimed is:

1. A photograph holding greeting card kit comprising:

a jacket made of cardstock comprising an exterior surface, an interior surface, at least one fold in said cardstock, and a front face on said exterior surface;

transparent pocket means disposed on said front face of said exterior surface of said jacket for receiving and holding a photograph of a predetermined size, provided by a user;

a selection of a plurality of inserts, each of said inserts comprising an exterior surface and an interior surface, said interior surface of said insert comprising distinctive message indicia preprinted thereon; and means for adhering said exterior surface of a selected one of said selection of a plurality of inserts to said interior surface of said jacket to provide a greeting card with a message appropriate to the photograph selected to be positioned and held within said transparent pocket means on said front face of said exterior surface of said jacket.

2. The invention of claim 1 wherein said adhering means comprises means for adhesively attaching said exterior surface of said selected insert to said interior surface of said jacket.

3. The invention of claim 2 wherein said adhesively attaching means comprises means for removably attaching said exterior surface of said selected insert to said interior surface of said jacket.

4. The invention of claim 1 wherein said adhering means comprises areas of adhesive disposed on said exterior surface of said selected insert.

5. The invention of claim 4 further comprising peel off covers disposed over said areas of adhesive whereby the user peels said covers from said areas of adhesive to expose said areas of adhesive and then positions and attaches said exterior surface of said selected insert to said interior surface of said jacket by adhering said areas of adhesive on said exterior surface of said insert to said interior surface of said jacket.

6. The invention of claim 1 wherein at least one of said selection of a plurality of inserts comprises a fold.

7. The invention of claim 6 wherein said insert and said jacket comprise adjacent sections divided by said fold and each of said sections of said insert comprises adhering means on said exterior surface of said insert.

8. The invention of claim 7 wherein said adhering means comprises strips of adhesive.

9. The invention of claim 7 wherein said insert is generally rectangular in shape and each of said adjacent sections divided by said fold comprises an upper edge, a lower edge, a side, edge, and a fold edge.

10. The invention of claim 9 wherein said adhering means comprises at least two strips of adhesive on said exterior surface of each said section, said adhesive strips disposed adjacent and essentially parallel to two edges of said insert.

11. The invention of claim 10 wherein said edges adjacent to which said adhesive strips are disposed are said upper and lower edges of said insert.

12. The invention of claim 10 wherein said edges adjacent to which said adhesive strips are disposed are said side and fold edges of said insert.

13. The invention of claim 10 comprising three adhesive strips disposed on said exterior surface of each said section, one strip disposed adjacent and essentially parallel to said upper edge and said lower edge, and said side edge of said insert.

14. The invention of claim 10 comprising four adhesive strips disposed on said exterior surface of each said section of said insert, one strip disposed adjacent and essentially parallel to said upper edge, said lower edge, said side edge, and said fold edge.

15. The invention of claim 1 wherein said adhering means comprises areas of adhesive on said interior surface of said jacket.

16. The invention of claim 1 wherein said adhering means comprises areas of adhesive disposed on said transparent pocket means for affixing said insert to said jacket.

17. The invention of claim 16 wherein said areas of adhesive further serve to affix said transparent pocket means to said jacket.

18. The invention of claim 1 further comprising additional adhering means for affixing said transparent pocket means to said jacket.

19. The invention of claim 1 wherein said jacket and said transparent pocket means comprise generally rectangular sheets comprising upper and lower edges, said sheet of said transparent pocket means being slightly longer than said front face of said exterior surface of said jacket, and said upper and lower edges of said sheet of said transparent pocket means being foldable over said upper and lower edges of said jacket.

20. The invention of claim 19 wherein said upper and lower edges of said transparent pocket means are folded over said upper and lower edges of said jacket and disposed between said jacket and said insert when said insert is adhered to said jacket.

* * * * *